US005615619A

United States Patent [19]

King

[11] Patent Number: 5,615,619

[45] Date of Patent: Apr. 1, 1997

[54] BLOCK PLAY TABLE

[76] Inventor: Christine L. King, 25455 Letchworth Rd., Beachwood, Ohio 44122

[21] Appl. No.: 377,700

[22] Filed: Jan. 25, 1995

[51] Int. Cl.[6] ..... A47B 7/00

[52] U.S. Cl. ..... 108/25; 446/75; D6/480; D6/397; 312/287; 312/285

[58] Field of Search ..... 108/25, 13, 62, 108/93, 90, 150, 186, 187, 193, 153, 157, 180; 312/351.2, 351.1, 204, 264, 263, 265.5, 287, 285, 289, 351.8, 351.5, 108; 297/188.01, 188.08; 446/118, 75; D6/451, 436, 484, 480, 397; 220/676

[56] References Cited

U.S. PATENT DOCUMENTS

| | | | |
|---|---|---|---|
| D. 93,576 | 8/1934 | Rice et al. . | |
| D. 182,832 | 5/1958 | Lubberts et al. | D6/436 |
| 202,294 | 4/1878 | Steves . | |
| D. 244,113 | 4/1977 | Friedman | D6/480 X |
| D. 299,600 | 1/1989 | Mollica | D6/480 |
| 351,240 | 10/1886 | Adair . | |
| D. 370,701 | 6/1996 | Thomsen . | |
| D. 371,399 | 7/1996 | Pardorf . | |
| 1,270,575 | 6/1918 | Wheeler . | |
| 1,880,386 | 10/1932 | Gray . | |
| 2,094,915 | 10/1937 | Dawson . | |
| 2,113,995 | 4/1938 | Salvage | 312/285 X |
| 2,240,395 | 4/1941 | Evans . | |
| 2,532,863 | 12/1950 | Taylor | 297/188.01 |
| 2,708,524 | 5/1955 | Kerr . | |
| 2,888,147 | 5/1959 | Goldberg . | |
| 3,004,814 | 10/1961 | Schulze | 312/140.3 X |
| 3,688,707 | 9/1972 | White | 108/25 X |
| 3,854,783 | 12/1974 | Teranishi | 108/153 X |
| 4,763,580 | 8/1988 | Garland | 312/265 X |
| 4,807,538 | 2/1989 | Hoffman . | |
| 4,872,410 | 10/1989 | Lilly . | |
| 4,986,756 | 1/1991 | Yamaguchi . | |
| 5,055,081 | 10/1991 | Nayak . | |
| 5,218,912 | 6/1993 | Buske | 108/26 |
| 5,250,000 | 10/1993 | Boutin et al. | 446/75 |
| 5,299,861 | 4/1994 | Foliot et al. . | |
| 5,327,838 | 7/1994 | Beltman . | |
| 5,360,264 | 11/1994 | Crane | 108/90 X |
| 5,375,536 | 12/1994 | Peters . | |
| 5,380,232 | 1/1995 | Berggreen et al. | 446/75 |
| 5,421,270 | 6/1995 | Kelly . | |
| 5,474,483 | 12/1995 | Sun . | |
| 5,509,844 | 4/1996 | Poirier et al. . | |

FOREIGN PATENT DOCUMENTS

| | | | |
|---|---|---|---|
| 1226197 | 10/1960 | France | 312/108 |
| 389965 | 3/1933 | United Kingdom | 312/269 |

OTHER PUBLICATIONS

P. 128 of Little Tikes catalog entitled "4566 Super Storage Building Table" circa 1995.

two-sided page of Today's Kids catalog showing "4–i –1 B i1 'n Play T ble" circa 1995.

Lego Dacta booklet entitled "Tools for Learning" cover page, pp. 18, 19 and back page 1993.

*Primary Examiner*—Peter M. Cuomo
*Assistant Examiner*—Janet M. Wilkens
*Attorney, Agent, or Firm*—Fay, Sharpe, Beall, Fagan, Minnich & McKee

[57] ABSTRACT

A play table includes a top and a base for supporting the top. The base can include a first leg secured at its upper end to the top and a second leg secured at its upper end to the top, the second leg being spaced from the first leg. A bottom wall is secured between the lower ends of the first and second legs. A front wall is secured to the first and second legs and the bottom wall and cooperates with them to define a bin housed under the top. An opening is provided in the front wall to define a front opening for the bin.

21 Claims, 5 Drawing Sheets

FIG. 1
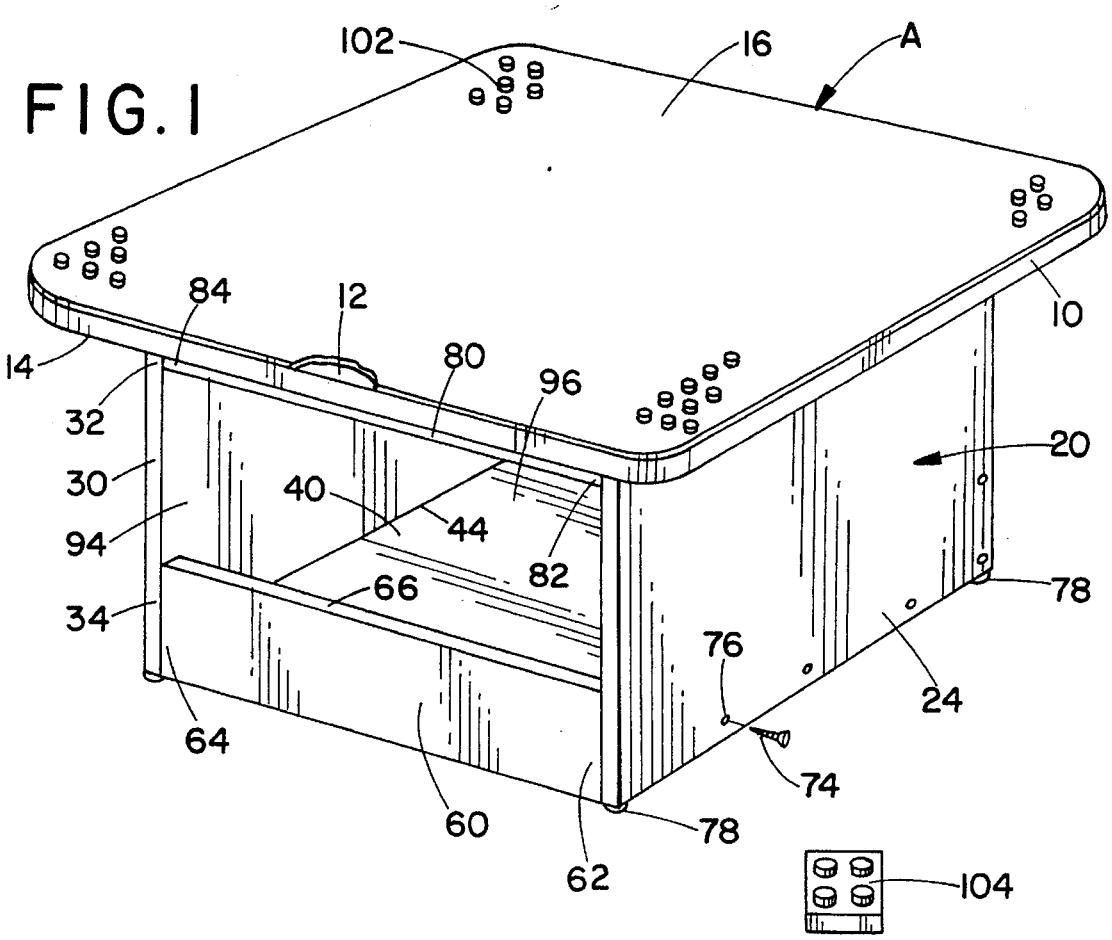
FIG. 2A
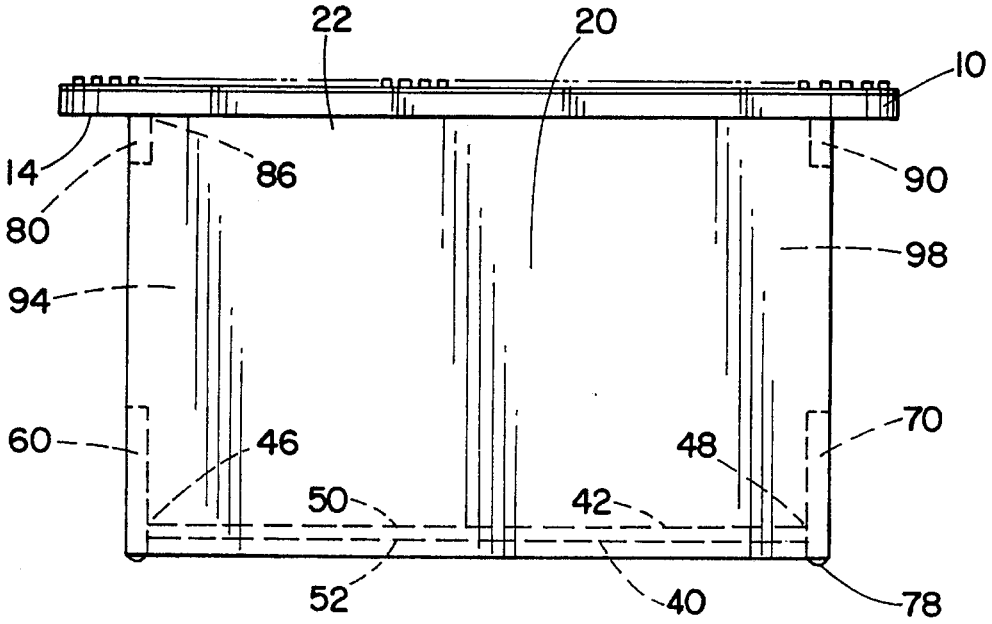
FIG. 2

BLOCK PLAY TABLE

BACKGROUND OF THE INVENTION

The present invention relates to a play table. More specifically, the invention relates to a play table having a storage feature.

The play table described herein can be used to provide a storage base for the elements of a modular building system when a block building plate is provided as the top of the table. However, it should be appreciated that a play table with a planar top could be used for other play purposes by a child.

Tables of one form or another have long been used for storing articles in proximity to a surface on which the articles are used. One common example of this is a desk in which one or more drawers are located below a flat top work surface.

In certain other contexts there is also a heightened need for storing articles in the same table having a work or play surface on which the articles are to be used. Perhaps the best example of this is in the context of children playing with a number of toys. It is desirable that the toys be stored as near as possible to the play location. Storage of the toys in the table reduces the possibility that the toys will be scattered on the floor after play time has ended because a ready toy storage area is available in the table.

One known play table includes a play surface on which a modular building system can be supported. This known structure includes a table top supported either by a plurality of legs or by a central pedestal leg. Storage for the modular building elements is provided in the form of a bag which is detachably secured to the underside of the table. The bag surrounds a through aperture in the table top so that building blocks can be placed in the bag through the aperture. This known design is disadvantageous because the aperture provided in the top reduces the amount of play surface available on the table top. This design is also disadvantageous from the standpoint that the detachable bags are incapable of holding a sizeable quantity of such modular building blocks or other toys. Another known block play table design provides a block building top surface with no storage feature beneath it at all.

Still another known play table design includes a table top defined by a plurality of lids atop bins which are supported by a subjacent board that is held in the frame of the play table. This known design is disadvantageous from the standpoint that the lids need to be removed in order to have access to the bins in which the play items are stored and play cannot resume until the lids are returned atop the bins. In addition, the bins, though there are several in number, can each only hold smaller items as the bins are rather small.

In addition, all of these known play table designs suffer from the disadvantage that they do not have a wide, stable base for securely supporting children who may be leaning or crawling on the tables.

Accordingly, it has been considered desirable to develop a new and improved play table which would overcome the foregoing difficulties and others while providing better and more advantageous overall results.

BRIEF SUMMARY OF THE INVENTION

In accordance with the present invention, a new and improved play table is provided.

More particularly in accordance with this aspect of the invention, the play table comprises a top and a first leg secured at its upper end to the top for supporting the top. A second leg is secured at its upper end to the top for supporting the top, the second leg being spaced from the first leg. A bottom wall is secured between the lower ends of the first and second legs. A front wall is secured to the first and second legs and the bottom wall. The front wall cooperates with the first and second legs and the bottom wall to define a bin housed under the top. An opening is provided in the front wall to define a front opening for the bin.

Preferably, the top has a larger circumference than the bin so that it overhangs the bin. Preferably also, the play table further comprises a rear wall secured to the first and second legs and the bottom wall wherein the rear wall is spaced from the front wall and includes an opening to define a rear opening for the bin. If desired, a front brace can be secured to the first and second legs and the top, the brace being spaced from the front wall such that the front opening is defined between them. A rear brace can also be secured to the first and second legs and the top, the rear brace being spaced from the rear wall such that the rear opening is defined between them.

If desired, the top can comprise a studded play surface, which accommodates associated blocks for interlocking engagement. If desired, the area of the studded play surface can be smaller than the area of the top in order to define a smooth play surface section on the top. If desired, a substantially vertically extending brace wall can be located between the first and second legs to divide the bin into separate storage compartments.

An advantage of the present invention is the provision of a new and improved play table.

Another advantage of the present invention is the provision of a play table which has a large storage bin beneath it so as to accommodate a sizeable volume of toys.

Another advantage of the present invention is the provision of a play table which has a wide base that is directly supported on the subjacent floor so as to prevent the table from being easily tipped by a child playing thereon.

A yet further advantage of the present invention is the provision of a play table having at least one access opening to a bin provided underneath a play surface so that toys can be stored in or removed from the bin. Preferably, more than one access opening is provided so that access may be had to the bin from different locations around the table.

A further advantage of the present invention is the provision of a play table with at least one storage bin underneath it in which an access opening to the storage bin is not closed by a door or the like. Closure doors are considered dangerous for a play table because children may pinch their fingers in the door. Also, children could conceivably become trapped inside the bin when the door is closed. Therefore, in the present invention the at least one storage bin is always accessible.

A still further advantage of the present invention is the provision of a play table having a top with a studded play surface. The studded play surface can accommodate associated blocks for interlocking engagement. Beneath the top is a base comprising a storage bin for storing the blocks.

A yet further advantage of the present invention is the provision of a play table having a top with a studded play surface wherein the studded play surface is smaller in area than the top in order to define a smooth play surface section on the top. For example, the smooth play surface may be of a shape of a racetrack around the periphery of the studded play surface so as to enable children to roll vehicles on the smooth surface while building on the studded surface.

Still further advantages of the present invention will become apparent to those of ordinary skill in the art upon the reading and understanding of the following detailed description of the preferred embodiments.

BRIEF DESCRIPTION OF THE DRAWINGS

The invention may take form in certain parts and arrangements of parts preferred embodiments of which will be described in detail in the specification and illustrated in the accompanying drawings which form a part hereof and wherein:

FIG. 1 is a perspective view of a play table according to a first preferred embodiment of the present invention;

FIG. 2 is a side elevational view of the play table of FIG. 1;

FIG. 2A is an enlarged perspective view of a block that can be used with a studded play surface located on the play table of FIG. 1;

DETAILED DESCRIPTION OF THE PREFERRED EMBODIMENTS

Figure 3:
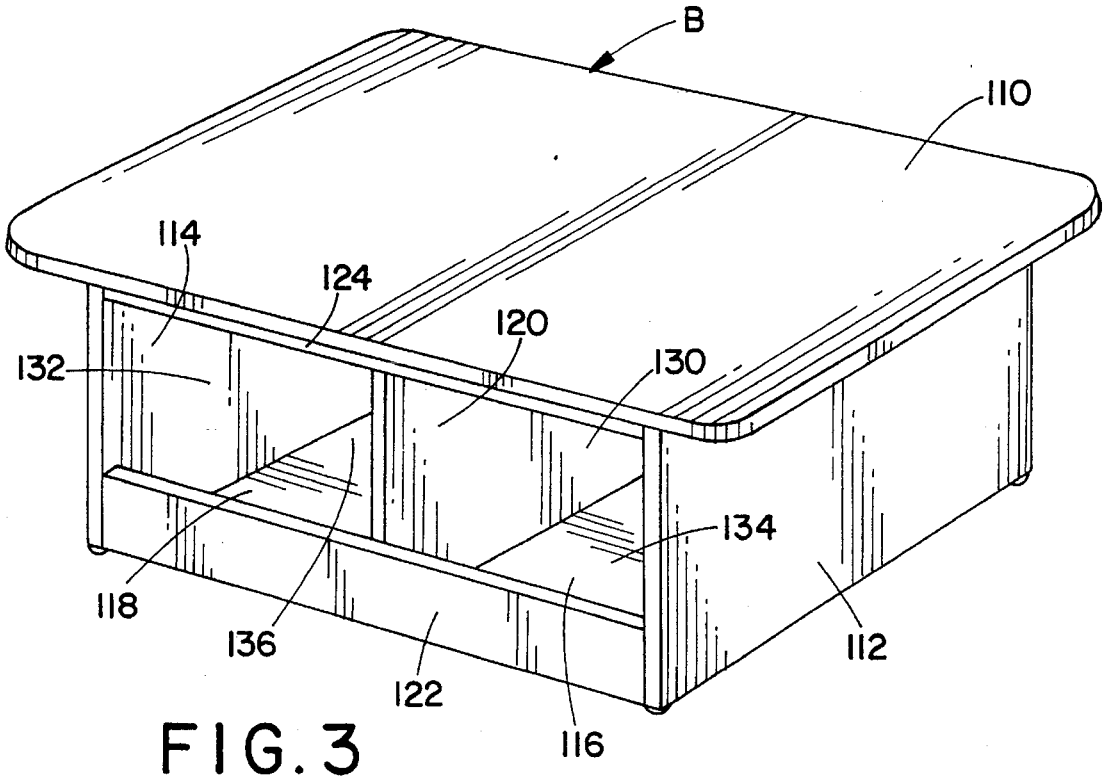
FIG. 3 is a perspective view of a second preferred embodiment of a play table according to the present invention.

Referring now to the drawings wherein the showings are for purposes of illustrating preferred embodiments of the invention only and not for purposes of limiting same, FIG. 1 shows a play table A according to a first preferred embodiment of the present invention. FIG. 1 illustrates that the play table A comprises a top 10 having an upper surface 12 and a lower surface 14. If desired, a block building plate 16 can be secured, as by a conventional adhesive, to the upper surface 10 of the play table. It is evident from FIG. 1 that the top 10 has rounded corners so as to reduce the possibility of harm to the children using the play table.

Supporting the play table is a base including a first leg 20 having an upper end 22 which is secured to the lower surface 14 of the play table as by screws, adhesive or the like (not visible). The first leg also has a lower end 24 which sits on a subjacent support surface such as the floor. Also provided is a second leg 30 which is spaced from the first leg. The second leg has an upper end 32 which is secured to the lower surface 14 of the top and a lower end 34 which rests on the subjacent support surface. The two legs 20 and 30 are widely spaced apart so as to provide a stable base for the top. Extending between the lower ends 24 and 34 of the first and second legs is a bottom wall 40. The bottom wall has a first side edge 42 secured to the first leg 20 and a second side edge 44 secured to the second leg 30. The bottom wall also includes a front edge 46 and a rear edge 48. The bottom wall 40 has an upper surface 50 and a lower surface 52.

With reference again to FIG. 1, the play table A preferably further comprises a front wall 60 which extends between the first and second legs 20 and 30 such that a first end 62 is secured to the first leg and a second end 64 is secured to the second leg. The front wall 60 also includes a top surface 66 which is accessible to a child playing on the table A.

With reference now to FIG. 2, the play table A further comprises a back wall 70 which, as with the front wall, is secured between the two legs 20 and 30. The means for securing the first and second legs 20 and 30 to the top 10 as well as the bottom wall 40 to the first and second legs and the front and back walls 60 and 70 to the first and second legs and the base wall can be suitable fasteners 74 which extend through apertures 76 provided in the relevant wall surfaces. Not all of the fasteners and apertures are illustrated in FIG. 1 for the sake of simplicity. In addition, it should be appreciated that other conventional means for securing the several walls of the play table together can also be provided, such as adhesive or the like.

The first and second legs 20 and 30, the bottom wall 40, the front wall 60 and the rear wall 70 together comprise a base. To prevent scratching, marring and the like of the subjacent floor surface, preferably the four corners of the base are provided with tips 78 of a conventional kind. These tips space the base away from the subjacent floor surface by approximately ¼" in order to insure that the floor surface does not become marred or scuffed by the base. In addition, these tips are advantageous from the standpoint of allowing the base to compensate for any floor unevenness. With reference now to FIG. 2, it can be seen that the bottom wall 40 is located slightly above the bottom edge of the legs and the front and back walls (on the order of about one fourth inch) in order to stiffen the construction of the base.

Preferably, the play table further comprises a front brace 80 which includes a first end 82 which is secured to the first leg 20, a second end 84 which is secured to the second leg 30 and a top wall 86 which supports the lower surface 14 of the top 10 and is secured thereto. A rear brace 90 can also be provided adjacent the rear end of the table. As with the front brace, the rear brace is similarly secured to the first and second legs 20 and 30 and to the top 10. Defined between the front wall 60 and the front brace 80 is a front access opening 94 of a bin 96 located in the base. In addition, a rear access opening 98 is defined between the back wall 70 and the rear brace 90, as illustrated in FIG. 2.

As shown in FIG. 1, the block building plate 16 comprises a plurality of spaced studs 102. These studs cooperate with a suitable studded building block 104, as illustrated in FIG. 2A. Such building blocks are sold by several corporations, the most well known of which is the Lego Corporation of Denmark which sells its building blocks under the trademarks Lego® and Duplo®. The storage bin 96 is of large volume and is capable of holding over one thousand preschool size playing blocks.

The components of the play table A, namely the top 10, and the base including the first and second legs 20 and 30, bottom wall 40, front and back walls 60 and 70 and front and rear braces 80 and 90 are preferably made from a suitable conventional material such as wood. The walls of the table are sufficiently thick so as to make for a strong and very safe play table which is adaptable for either commercial use or home use. In the preferred embodiment, the material employed is a pressed laminated board sold under the trademark Melamine®. The Melamine® material is advantageous from the standpoint that it is sturdy and easy to clean. It should be appreciated, however, that the several elements of the play table could also be made from an injection molded plastic material, much like the play tables which are manufactured by, e.g., Little Tykes Corporation and Step Two Corporation.

As is evident from FIG. 2, the top 10 overhangs the base. Such overhang may be on the order of 4". The overhang is useful to accommodate the legs of children who may be seated adjacent the play table and playing on the top 10 thereof. If desired, the table top can rest at a height of approximately 20" off the ground. In the embodiment of FIG. 1, the table top is sized to have a play area of approximately 31"×31". Obviously, it should be appreciated that other dimensions can be provided for the height of the play table top 10, the overhang of the top over the base, the size of the table top and the like.

It should be appreciated that no doors are provided to close the access openings 94 and 98 of the play table. The absence of such doors is advantageous from the standpoint that children playing on the table will not get their fingers pinched in a door, nor become trapped inside the bin 96 if any such doors were to be closed.

With reference now to FIG. 3, a second preferred embodiment of a play table B according to the present invention is there illustrated. This embodiment employs a top 110, a first leg 112, a second leg 114, a first bottom wall 116 and a second bottom wall 118. The two bottom walls are separated by a center dividing wall 120. Also provided is a front wall 122 and a front brace 124 which, together with the center dividing wall 120, define a pair of access openings 130 and 132 to a pair of bins 134 and 136.

It is noted that the play table B does not have a block building plate secured to the top 110. The standard play top of FIG. 3 is advantageous for holding puzzles, games or even a child's lunch. This version of the play table can be rectangular in shape and have dimensions of 31" by 47" for the top or, alternatively, dimensions of 39"×55". If desired, the top can have a height of 20". The two bins 134 and 136 defined are capable of storing even extra large books, toys or art supplies or any other type of toy. Again, the Melamine® material can be employed for the table to allow for easy cleanup.

Figure 4:
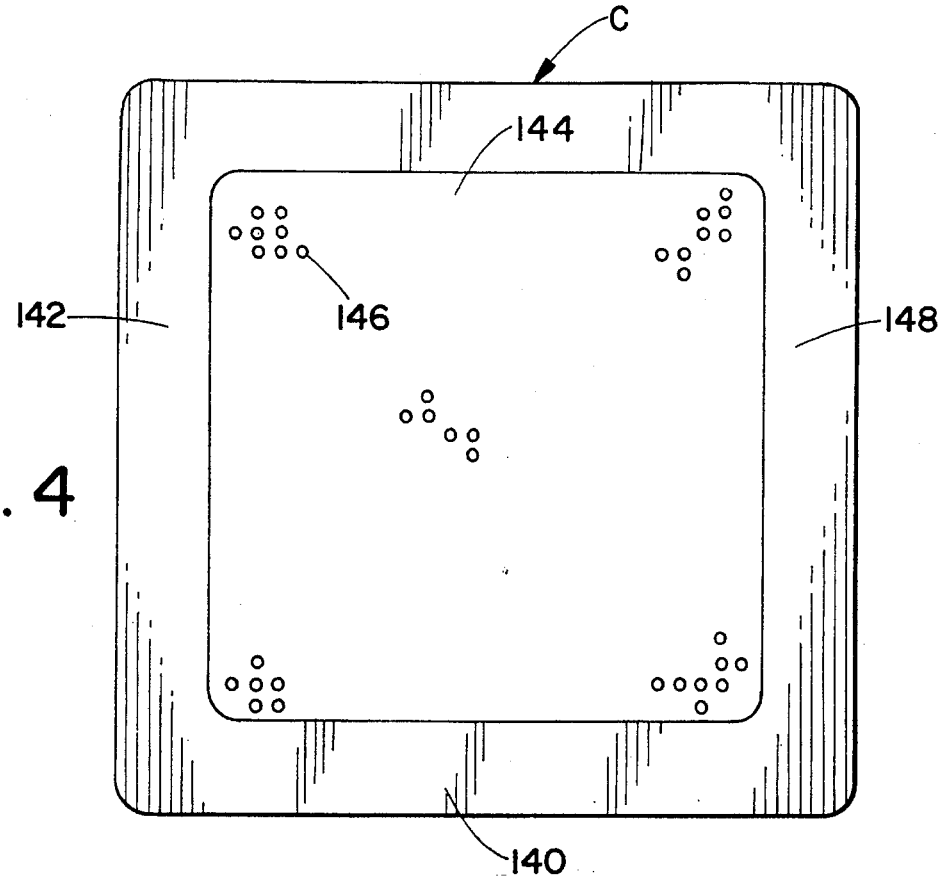
FIG. 4 is a top plan view of a play table according to a third preferred embodiment of the present invention.

With reference now to FIG. 4, there provided is a play table C according to a third preferred embodiment of the present invention. This play table includes a top 140 having an upper surface 142 to which is secured a block building plate 144 having a plurality of spaced studs 146. However, in the embodiment of FIG. 4, the block building plate 144 is smaller in circumference than is the top 140. Therefore, a smooth surface area in the form of a track 148 is defined on the upper surface 142 of the top around the periphery of the plate 144. Such a smooth surface area is useful for children who wish to play with wheeled toys adjacent the block building plate. The track around the periphery of the block building plate 144 in FIG. 4 is also advantageous for providing space for other types of non-construction toys.

The play table C can have a top with, e.g., a 39"×39" substantially square surface, if desired or a substantially rectangular surface which may have dimensions of 39"×55", if desired. While the block building plate 144 is illustrated as being substantially square in FIG. 4 so as to define a peripheral smooth surface area or track 148, it should be appreciated that other track configurations could be provided if so desired. For example, a FIG. 8 configuration could be created by providing a pair of spaced block building plates on a table top separated by a central smooth surface area.

Figure 5:
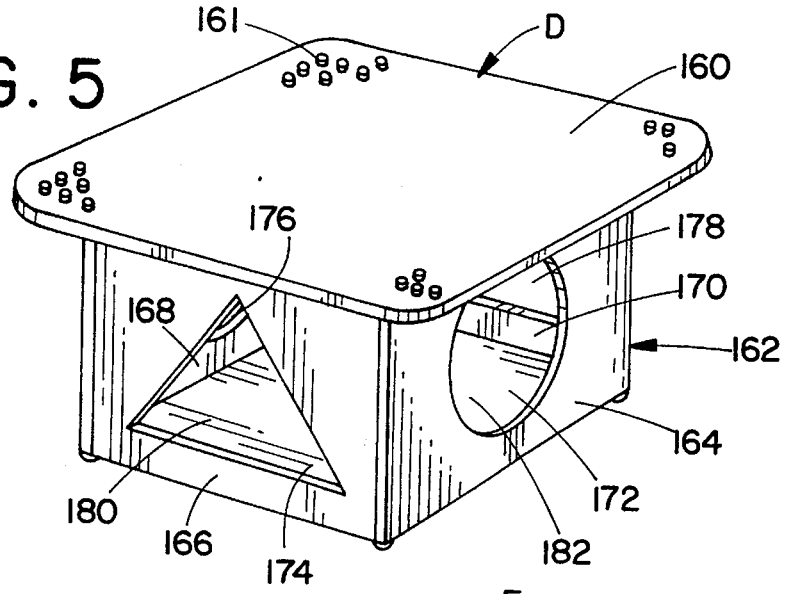
FIG. 5 is a perspective view of a play table according to a fourth preferred embodiment of the present invention.
Figure 6:
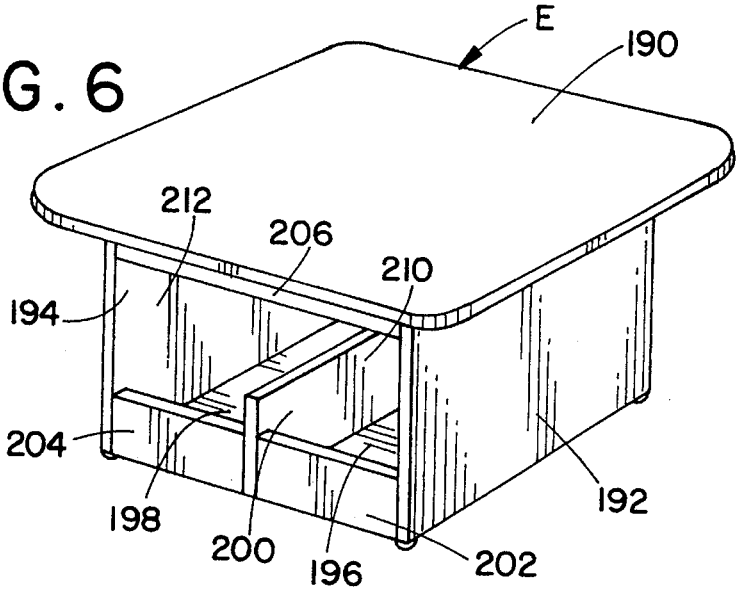
FIG. 6 is a perspective view of a play table according to a fifth preferred embodiment of the present invention.
Figure 7:
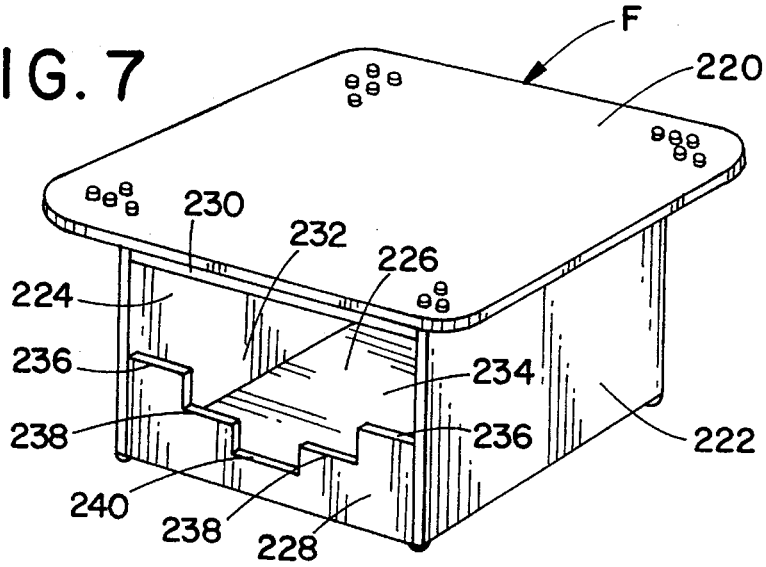
FIG. 7 is a perspective view of a play table according to a sixth preferred embodiment of the present invention.

With reference now to FIGS. 5, 6 and 7, still other table designs are there illustrated. Play table D illustrated in FIG. 5 shows a design in which a top 160 having a play surface comprising a plurality of spaced studs 161. The top is supported by a base 162 comprised of four walls 164, 166, 168 and 170. Extending through each of these walls is a respective aperture 172, 174, 176 and 178. It is noted that each of the apertures has a different configuration. A bottom wall 180 is secured to all of the four side walls 164–170. In this way, there is provided a bin 182 which is accessible from all four sides of the play table D. Use of four different designs for the apertures may be pleasing to a child who is using the play table. The use of four apertures also allows access to the contents held in the bin 182 from all four sides of the play table D.

With reference now to FIG. 6, another preferred embodiment of a play table E includes a top 190 with a smooth play surface and first and second legs 192 and 194. Also provided are first and second bottom walls 196 and 198 which are separated by a center divider 200 such that the first bottom wall is secured to the first leg 192 and the center divider on one side thereof and the second bottom wall 198 is secured to the second leg 194 and the other side of the center divider 200. Also provided are first and second front walls 202 and 204 and a front brace 206. These elements cooperate to define a first bin area 210 and a second bin area 212 in the base. It is evident that the dividing wall 200 does not completely separate the first and second bins 210 and 212 so that larger items, such as stuffed toys which are wider than, for example, the first bin, can still fit within the storage area provided underneath the top 190.

With reference now to FIG. 7, yet another preferred embodiment F of a play table is there illustrated. In this embodiment, the play table has a top 220 which is provided with first and second legs 222 and 224 as well as a bottom wall 226 which extends between the pair of legs 222 and 224. Also provided is a front wall 228 and a front brace 230. The front wall and the front brace define between them an opening 232 leading to a storage bin 234. In this embodiment, the front wall 228 is stepped in configuration so as to have a variety of different heights. More particularly, the front wall includes a pair of spaced outer sections 236 of a first height, a pair of spaced middle sections 238 of a second and shorter height and a center section 240 of a third and yet shorter height. This embodiment may be useful in allowing easier access for young children to the storage bin provided underneath the top 220.

Figure 8:
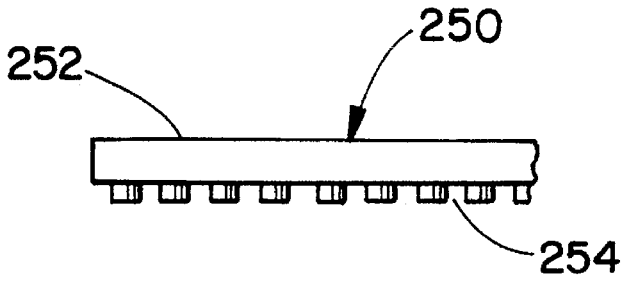
FIG. 8 is a side elevational view of a portion of a table top which can be employed with a studded play surface as illustrated in several of the above embodiments to convert a studded table top into a smooth surface.

With reference now to FIG. 8, a conversion top is there illustrated in cross-sectional view. The conversion top 250 can be readily attached to or detached from the block building plate 16 illustrated, e.g. in FIG. 1. The conversion top converts the block building plate upper surface of the top 10 into a flat surface for games, lunch or activities in seconds. The conversion top comprises a smooth first, or top surface 252, and a studded second or bottom surface 254 which can mate and cooperate with the block building plate 16 illustrated in FIG. 1. That is, the two building plates have interengaging studs in order to secure the conversion top to the table top when desired. When the activity requiring a flat surface is over, the conversion top 250 can be detached so as to again expose the block building plate 16 and allow use again of the building blocks stored in the bin of the table.

It is noted that FIG. 8 illustrated a top which is preferably made of plastic so that the studded surface 254 can be integral with the top. It should be appreciated, therefore, that the various embodiments of a play table illustrated in the instant application could similarly be manufactured from a plastic material, such as by injection molding or the like.

Figure 9:
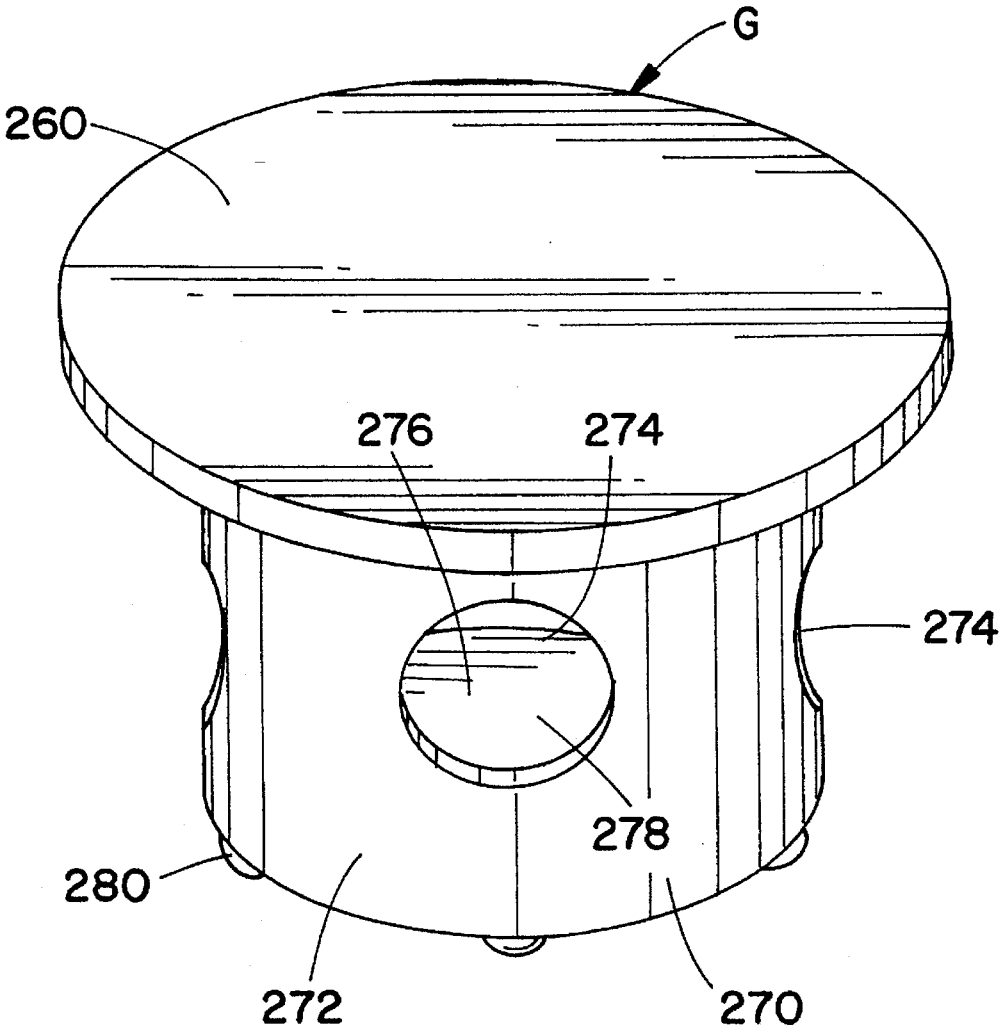
FIG. 9 is a perspective view of a play table according to a seventh preferred embodiment of the present invention.

FIG. 9, illustrates a yet seventh preferred embodiment of a play table G is there illustrated. In this embodiment, the table includes a circular flat top 260 which is supported by a rounded base 270 of smaller circumference than the top. The base can comprise a side wall 272 which is provided with a plurality of apertures 274 which allow access to a storage bin 276 formed by a cooperation of the base side wall 272 with a base bottom wall 278. If desired, the base can be supported on a plurality of tips 280. In this embodiment, the table is circular rather than being square or rectangular as in the other embodiments. In addition, rather than having one or more planar legs to support the table top 260, the base 270 includes a curved side wall 272.

Figure 10:
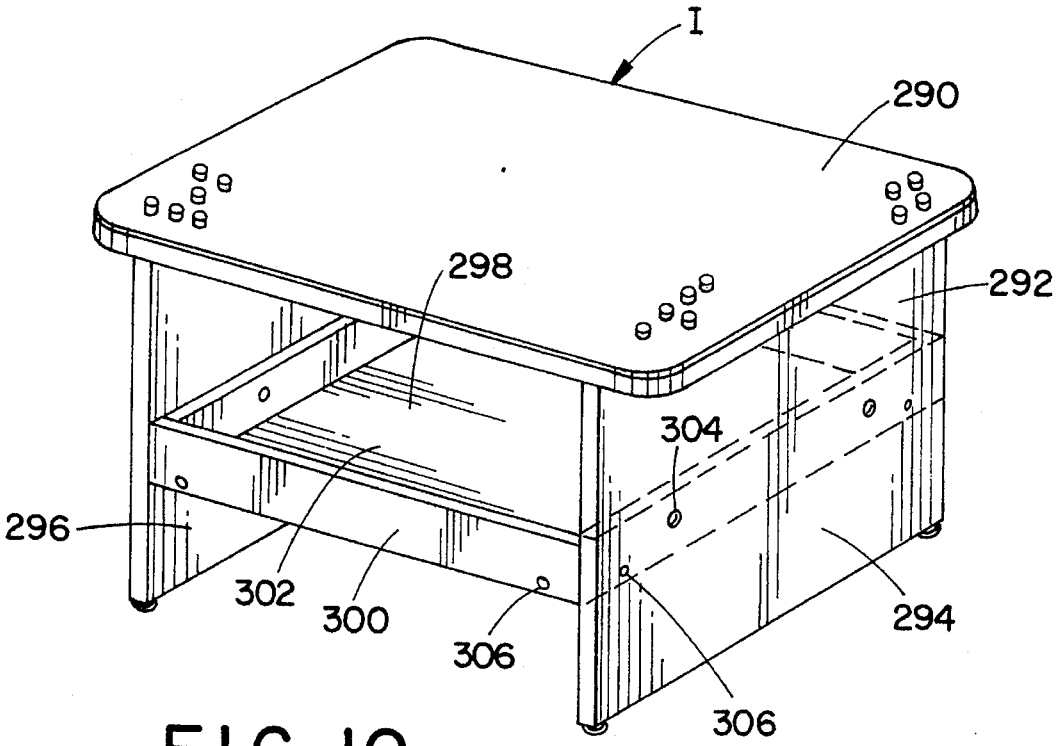
FIG. 10 is a perspective view of a play table according to an eighth preferred embodiment of the present invention; and, FIG. 11 is a perspective view of a play table according to a ninth preferred embodiment of the present invention.

With reference now to FIG. 10, an eighth preferred embodiment of a play table I according to the present invention includes a top 290 which is supported by a base 292. The base comprises first and second legs 294 and 296 and a bin 298 extending therebetween. The bin is made of four side walls 300 and a bottom wall 302. Suitable fasteners 304 secure the side walls 300 of the bin to the legs 294 and 296 of the base. Other suitable conventional fasteners 306 secure the bottom wall 302 of the bin to its side walls 300. In contrast with the embodiments illustrated previously, the bin 298 is shown as being spaced from the subjacent support surface by an amount adequate to also afford storage beneath the bin for larger sized items, such as stuffed animals and the like.

Figure 11:
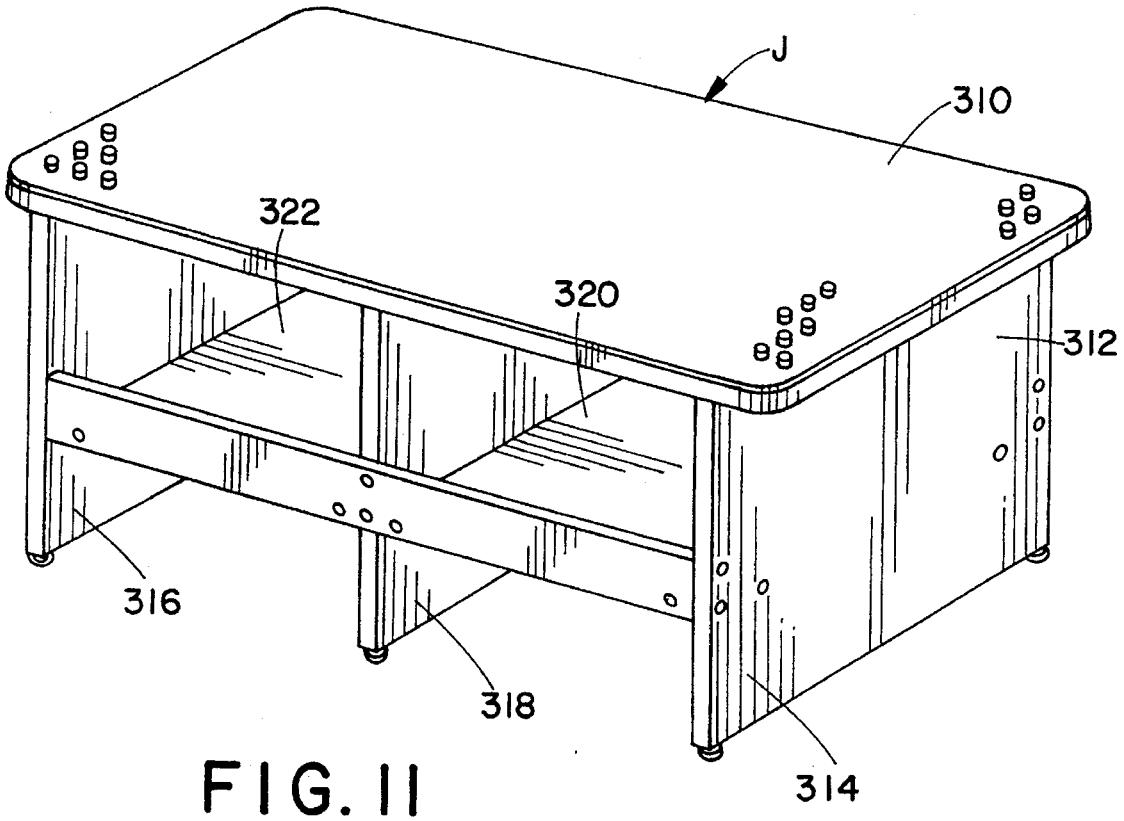

Finally, with reference now to FIG. 11, a yet ninth preferred embodiment of a play table J is there illustrated. In this embodiment, the table includes a top 310 supported by a base 312. The base includes first and second legs 314 and 316, one located adjacent each side edge of the top 310 as well as a central leg 318. Defined between the three legs 314, 316 and 318 are a pair of bins 320 and 322. As with the embodiment of FIG. 10, the bins 320 and 322 are spaced away from the adjacent support surface.

The invention has been described with reference to preferred embodiments. Obviously, modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A play table comprising:

a top having first and second side edges;

a first planar leg secured at its upper end to said top adjacent said first side edge thereof and extending along substantially the entirety of said first side edge for supporting said top;

a second planar leg secured at its upper end to said top adjacent said second side edge thereof and extending along substantially the entirety of said second side edge for supporting said top wherein an upper edge of each of said first and second legs is located beneath said top;

a bottom wall positioned between said first and second legs and secured thereto;

a front wall positioned between said first and second legs and secured thereto, a lower edge of said front wall being located adjacent and secured to said bottom wall, wherein said front wall cooperates with said first and second legs and said bottom wall to define a bin housed under said top and wherein said front wall is of less height than said first and second legs to define a front opening for said bin; and, a rear wall secured to said first and second legs, a lower edge of said front wall being located adjacent said bottom wall, wherein said rear wall is spaced from said front wall.

2. The play table of claim 1 wherein said top has a larger circumference than said bin and overhangs said bin.

3. The play table of claim 1 wherein said rear wall is of less height than said first and second legs to define a rear opening for said bin.

4. The play table of claim 3 further comprising a front brace secured to said first and second legs and said top, said brace being spaced from said front wall such that said front opening is defined between them.

5. The play table of claim 4 further comprising a rear brace secured to said first and second legs and said top, said rear brace being spaced from said rear wall such that said rear opening is defined between them.

6. The play table of claim 1 wherein said top comprises a studded play surface, said studded play surface accommodating associated blocks for interlocking engagement.

7. The play table of claim 6 wherein said studded play surface is smaller in area than an area of said top in order to define a smooth play surface section on said top.

8. The play table of claim 1 further comprising a substantially vertically extending brace wall located between said first and second legs.

9. A play table for use with a modular building system having a plurality of interlocking elements, comprising:

a substantially horizontal planar top including a studded play surface accommodating associated blocks for interlocking engagement;

a base secured at its upper end to a bottom face of said top for supporting said top, said base comprising a pair of spaced planar side walls located adjacent opposing side edges of said top, a front wall, a rear wall and a bottom wall extending between said side walls at a lower end thereof and terminating thereat and extending from said front wall to said rear wall and terminating thereat, wherein said rear wall is located adjacent a rear edge of said top, said side, front, rear and bottom walls cooperating to define a bin located beneath said top; and, a first opening located in said front wall of said base to provide access to said bin for storing the associated blocks.

10. The play table of claim 9 wherein an area of said studded play surface is smaller than an area of said top in order to define a smooth surface portion on said top.

11. The play table of claim 9 further comprising a substantially vertically extending divider wall in said base for separating said bin into two adjacent storage areas.

12. The play table of claim 9 further comprising a second opening in said rear wall of said base to provide additional access to said bin.

13. The play table of claim 12 wherein said first and second openings are of different shapes.

14. A play table comprising:

a substantially horizontally oriented top;

a base supporting said top, said base forming a storage bin and comprising:

first and second substantially vertically oriented spaced side walls secured at their upper ends to said top adjacent opposed side edges of said top and extending along substantially the entirety of said opposed side edges, a front wall and a rear wall secured to said first and second side walls adjacent opposed end edges of said top, and a substantially horizontally extending bottom wall having opposed end edges positioned between a lower end of each of said first and second side walls and secured thereto, said bottom wall being located adjacent a subjacent support surface to provide a stable support for said top, wherein said top overhangs said base such that a circumference of said top is larger than a circumference of said base; and, an aperture located in said base to define a first opening for said bin.

15. The play table of claim 14 wherein said front wall is of a shorter height than said first and second side walls and, further comprising a front brace secured to said first and second side walls and said top, said front brace being spaced from said front wall such that said first opening is defined between them.

16. The play table of claim 15 wherein said rear wall is of a shorter height than said first and second side walls and, further comprising a rear brace secured to said first and second side walls and said top, said rear brace and rear wall defining between them a second opening for access to said bin.

17. The play table of claim 14 further comprising a substantially vertically oriented brace wall located between said first and second side walls and secured to said bottom wall to separate said bin into two compartments.

18. A play table comprising:

a substantially horizontally oriented top including a studded play surface, said top having first and second side edges;

a base supporting said top, said base forming a storage bin and comprising:

a first leg secured at its upper end beneath said top adjacent said first side edge thereof wherein said first leg extends along substantially the entirety of said first side edge, a second leg secured at its upper end beneath said top adjacent said second side edge thereof, wherein said second leg extends along substantially the entirety of said second side edge, a substantially horizontally oriented bottom wall having opposed side edges secured to said first and second legs adjacent respective lower ends thereof, a first side wall secured between said first and second legs and secured to said bottom wall, and a second side wall secured between said first and second legs, said second side wall being spaced from said first side wall, wherein said first side wall cooperates with said first and second legs, said second side wall and said bottom wall to define a bin housed under said top and wherein said first side wall is of less height than said first and second legs to define an opening for said bin.

19. The play table of claim 18 further comprising a tip secured on said lower end of each of said first and second legs for spacing said bottom wall of the play table away from a subjacent support surface.

20. The play table of claim 18 wherein a circumference of said top is larger than a circumference of said base so that said top overhangs said base.

21. The play table of claim 18 wherein said studded play surface has a smaller area than an area of said top.

* * * * *